US005618861A

United States Patent [19]

Hlivka et al.

[11] Patent Number: 5,618,861

[45] Date of Patent: Apr. 8, 1997

[54] PITCH CONTROL COMPOSITION AND PROCESS FOR INHIBITING PITCH DEPOSITION

[75] Inventors: Linda M. Hlivka, Flemington; George K. Wai, Mountain Lakes, both of N.J.

[73] Assignee: Ashland Inc., Columbus, Ohio

[21] Appl. No.: 432,077

[22] Filed: May 1, 1995

[51] Int. Cl.[6] ..... C08L 5/02

[52] U.S. Cl. ..... 524/55; 162/164.1; 162/164.3; 162/168.1; 162/178

[58] Field of Search ..... 524/55; 162/164.1, 162/164.3, 178, 168.1, DIG. 4

[56] References Cited

U.S. PATENT DOCUMENTS

| | | | |
|---|---|---|---|
| 4,248,708 | 2/1981 | Wilson | 210/727 |
| 5,266,166 | 11/1993 | Dreisbach et al. | 162/199 |
| 5,292,403 | 3/1994 | Dreisbach et al. | 162/158 |
| 5,368,694 | 11/1994 | Rohf | 162/199 |
| 5,439,673 | 8/1995 | Murray | 424/70.12 |

FOREIGN PATENT DOCUMENTS

| | | | |
|---|---|---|---|
| 599440 | 6/1994 | European Pat. Off. | D21H 21/02 |

*Primary Examiner*—Edward J. Cain
*Attorney, Agent, or Firm*—David L. Hedden

[57] ABSTRACT

This invention relates to a liquid composition for the control of pitch deposition in pulp and paper making comprising an aqueous solution of (1) a derivatized cationic guar, and (2) a nonionic polymer. The invention also relates to a process for inhibiting pitch deposition in pulp and papermaking systems and on papermaking equipment

8 Claims, No Drawings

PITCH CONTROL COMPOSITION AND PROCESS FOR INHIBITING PITCH DEPOSITION

TECHNICAL FIELD OF THE INVENTION

This invention relates to a liquid composition for the control of pitch deposition in pulp and paper making operations comprising an aqueous solution of (1) a derivatized cationic guar, and (2) a nonionic polymer. The invention also relates to a process for inhibiting pitch deposition on paper making equipment.

BACKGROUND OF THE INVENTION

In a broad sense, "pitch" is any "sticky" substance found in the papermaking process. Sticky substances create problems in the paper making process when they deposit on paper making equipment. More specifically "pitch" refers to any soluble organic matter originating from the extracts of wood including fatty acids and esters, resin acids, and sterols. Pitch may also include process additives such as defoamers, sizing agents, and coatings, as well as inorganic components like calcium carbonate, silica, clay, magnesium and titanium. Pitch is released from wood during chemical and mechanical pulping.

Fine particles of pitch that remain well-dispersed do not create a deposition problem. However, there is a tendency for the hydrophobic pitch particles to agglomerate at the air-water interface. These pitch particles form deposits due to their decreased solubility as they move downstream (through cooler temperatures and lower pHs) and from the increased turbulence of the process. These pitch particles aggregate to form tacky threads or balls which then deposit on paper making equipment including chest walls, screens, paper machine headbox, wires, felts and dryers. This can also lead to sheet holes and breaks in paper resulting in increased downtime and/or lower quality paper.

Pitch deposition can be also be a problem in recycled or secondary fiber processes where organo-soluble pitch contaminants called "stickies", such as hot melts, polyethylene films, latexes, pressure sensitive adhesives, and waxes agglomerate and form deposits. These pitch contaminants deposit on equipment which similarly causes processing difficulties and decreases the quality of the final sheet.

Pitch control agents typically used for years are nonionic surfactants, especially nonyl phenol ethoxylates, talc and alum. Nonionic surfactants, which contain both a hydrophobic and hydrophilic segment, decrease the surface tension, provide wetting, detergency and dispersancy. However, nonyl phenol ethoxylates have a high foaming tendency which may result in higher defoamer usage, thus depositing more pitch. Talc is also used to control pitch deposition by adsorbing colloidal pitch onto the talc particles so it is retained in the sheet. The disadvantage of using talc is that it tends to deposit further downstream especially in paper machine felts and cause felt plugging. In acid paper making systems, alum or aluminum sulfate is used to decrease the tackiness of the pitch by cationic fixation to pulp. When using alum, pH control is critical to prevent deposition of alum.

U.S. Pat. No. 5,266,166 discusses a method for reducing pitch in paper making systems using an effective amount of polyalkylene oxide/vinyl acetate graft copolymer. U.S. Pat. No. 5,292,403 discloses methods for detackifying pitch employing a charged polymer and oppositely charged surface active agent. U.S. Pat. No. 4,964,955 teaches the use of a highly charged cationic polymer adsorbed into a water insoluble substrate thus forming a three dimensional cationic particle that attracts anionic pitch particles and prevents deposition. U.S. Pat. No. 5,230,808 teaches the use of polyethylene oxide in combination with glycol and glycerine as an effective flocculating agent for improving the clarification of waste water in the pulp and paper industry.

SUMMARY OF THE INVENTION

This invention relates to a liquid composition for the control of pitch deposition in pulp and paper making comprising:

(1) a derivatized cationic guar, and (2) a nonionic polymer, preferably a polyethylene oxide polymer.

The invention also relates to a process for inhibiting pitch deposition on paper making equipment. It can be used for hardwood and softwood pulp and papermaking processes.

Not only is pitch deposition controlled by using the subject compositions, but the ionic balance of the papermaking system is not disturbed thus limiting detrimental interactions with other process additives. Additionally, the liquid composition does not generate additional foam for the system to handle.

ENABLING DISCLOSURE AND BEST MODE

The derivatized cationic guar used in the pitch inhibiting composition is a powder. Guar gum is a nonionic galactomannan (MW=250,000 to 2 million) as obtained from the endosperm of the seed of the guar plant. To derivatize the guar, the nonionic guar is reacted with hydroxy propyl trimonium chloride to a certain degree of substitution which establishes the amount of cationic charge or charge density value in meq/g according to a proprietary process. Preferred derivatized cationic guars have a charge density of 0.01 meq/g to 3.0 meq/g, preferably 0.01 meq/g to 0.15 meq/g. Particularly preferred as the derivatized cationic guar are hydroxypropyl trimonium chloride, n-hance 3000, Galactosol 80 $H_2C$, and Jaguar 8913,8914 and 8917.

The nonionic polymers are hydrophilic polymers due to the presence of their ethylene oxide segment, but are not surfactants because they do not contain any polymeric segment that functions as a hydrophobe. Although minor amounts of a hydrophobic segment will not detract from their performance, the polymers preferably do not contain a hydrophobic segment.

Most preferred polyethylene oxide polymers are represented by the formula:

$$(CH_2CH_2O)_n$$

wherein "n" is a number such that those polymers will have an average molecular weight of from about 400,000 to about 12,000,000. Specific examples of such polymers include POLYOX N-3000 (MW=400,000), POLYOX 205 (MW=600,000), and POLYOX 1105 (MW=900,000). Preferably used as the nonionic polymer are polyethylene oxide polymers having an average molecular weight of about 400,000 to 1,000,000, as determined by intrinsic viscosity measurements.

The polyethylene oxide polymers are powders at room temperature. They are dissolved in water to make solutions by dissolving from 1–20 parts polyethylene oxide polymer, preferably 1–5 parts polyethylene oxide polymer, per 100 parts water. Preferably, the cationic guar derivative is added to the solution of polyethylene oxide polymer in water. Typically from 1–20 parts, preferably from 3–4 parts, of cationic guar derivative are added per 100 parts of polyethylene oxide polymer solution.

The formulation of the pitch control composition is such that it may contain from 1–20 weight percent cationic guar and 1–20 weight percent polyethylene oxide stabilized in an aqueous solution, said weight percents being based upon the total weight of the aqueous pitch control solution. Preferably the weight ratio of cationic guar to polyethylene oxide polymer is from 5:1 to 1:5, preferably from 3:1 to 1:3, most preferably 2.1 to 1.2.

The invention also relates to a process for inhibiting pitch deposition on paper making equipment. The amount of pitch control composition needed to effectively reduce the amount of sticky substances in the paper pulp is from 0.1 ppm to 100 ppm based upon the weight of the dry fiber. The pitch control composition can be added to any feedpoint in the pulp and papermaking process, for instance the first, second, or third stage washers of the pulp mill, the deckers of the pulpmill, the screens, post bleaching operations, and the paper machine itself.

The pitch control composition may be stabilized with a glycol (hexylene, propylene or ethylene), typically 1.0 to 4.0 percent by weight, preferably about 2.0 percent by weight, and/or an acid, typically up to 0.5 percent by weight, preferably about 0.25 percent by weight (hydrochloric, sulfuric, phosphoric acetic or nitric) for viscosity modification to impart flow characteristics, where said weight percent is based upon the weight of aqueous pitch control composition.

The pitch control compositions reduce pitch deposition under Kraft brownstock washer/screen room conditions in laboratory simulations at a dosage of 0.10 ppm to 100 ppm based on the weight of dry fiber, preferably at a dosage of 50 ppm, most preferably at a dosage of 15 ppm to 50 ppm. The following abbreviations are used in the examples which follow:

ABBREVIATIONS

DCG=derivatized cationic guar.

DCG #1=guar hydroxypropyl trimonium chloride having a charge density=0.03 meq/g)

DCG #2=guar hydroxylpropyl trimonium chloride having a charge density=0.15 meq/g).

DCG#1/PEO=a blend of DCG #1 and PEO (mw=600,000) in a weight ratio of 2.13 to 1.0.

NGG=nonionic galactomannan (guar gum).

NPE=nonyl phenol ethoxylate ethoxylated with 9 moles of ethylene oxide.

PEO 400,000=POLYOX n-3000, polyethylene oxide having a average molecular weight of 400,000.

PEO 600,000=POLYOX WSR-205, polyethylene oxide having a average molecular weight of 600,000.

PEO 900,000=POLYOX 1105, polyethylene oxide having a average molecular weight of 900,000.

Preparation of Synthetic Pitch

A synthetic pitch mixture was prepared in the laboratory and deposition tests were run to determine efficacy. A 0.5% consistency pulp slurry was prepared in a metal beaker using unbleached softwood or hardwood pulp and heated to 50° C. Then a tall oil fatty acid was introduced into the slurry with agitation, by a propeller-type mixer, followed by sodium carbonate and calcium chloride to create a colloidal pitch solution. Additionally, 0.25% corresponding hardwood or softwood black liquor and 0.1% of an oil based defoamer were added. Final pH was adjusted to 10.0–10.5. Temperature and agitation were maintained for a period of ten to thirty minutes.

TEST OF PITCH CONTROL AGENTS296

The slurry was subjected to mechanical shear which forced the pitch out of solution to deposit on the sides and bottom of the beaker and along the shaft of the stainless steel agitator. After the mixing period, the beaker and agitator were gently rinsed to remove fibers. The amount of deposition was determined by the difference of the initial weights of the beaker and agitator subtracted from the oven-dried final weights. The deposition reduction for treated samples was expressed as a percentage based on the total deposit weight recorded for a control (untreated) sample. The treated samples were prepared by adding aqueous solutions of the polymers listed in the Tables I, II, and II to the pitch slurry an amount of 50 ppm based upon the amount of the sample treated. The polymer solutions were prepared by mixing 5 parts of polymer with 100 parts of water. The results are reported in Table I for softwood pitch deposition. The blank did not contain any treatment. Examples C-1 to C-3 are comparison examples and contain a polyethylene oxide alone. Example C-4 is a nonionic surfactant, nonyl phenol ethoxylate. Examples C-4 5 and C-6 are comparisons of cationic guar derivatives with varying charge densities. Example C-7 is a comparison of a nonionic guar compound.

TABLE I

COMPARISON OF POLYETHYLENE OXIDE AND DERIVATIZED CATIONIC GUAR ALONE TO MIXTURES OF POLYETHYLENE OXIDE AND DERIVATIZED CATIONIC GUAR IN REDUCING SOFTWOOD PITCH DEPOSITION

| EXAMPLE | Active Dosage (ppm) | Deposition(mg) | % Pitch Reduction |
|---|---|---|---|
| Blank A | 0 | 312.0 | 0 |
| C-1 PEO 400,000 | 50 | 80.9 | 74.1 |
| C-2 PEO 600,000 | 50 | 55.2 | 82.3 |
| C-3 PEO 900,000 | 50 | 77.8 | 75.1 |
| C-4 NPE | 50 | 119.0 | 38.1 |
| C-5 DCG #1 | 50 | 54.8 | 82.4 |
| C-6 DCG #2 | 50 | 87.2 | 72.05 |
| C-7 NGG | 50 | 137.0 | 56.1 |
| 1 DCG #1/PEO 600,000 | 50 | 26.4 | 91.5 |

The results of Table I demonstrate that the DCG/PEO blend, having a weight ratio of DCG/PEO of 2.13:1, is effective in reducing softwood pitch deposition relative to the controls at the same active dosage. The data indicates a synergism between the cationic guar derivative and the polyethylene oxide resulting in enhanced performance and decreased deposition of softwood pitch relative to the individual components when tested alone under brown stock washer/screen room conditions. Similar results were achieved with hardwood pitch as shown in Table II.

TABLE II

COMPARISON OF POLYETHYLENE OXIDE AND DERIVATIZED CATIONIC GUAR ALONE TO MIXTURES OF POLYETHYLENE OXIDE AND DERIVATIZED CATIONIC GUAR IN REDUCING HARDWOOD PITCH DEPOSITION

| Sample | Active Dosage (ppm) | Deposition (mg) | % Pitch Reduction |
|---|---|---|---|
| Blank B | 0 | 486.1 | |
| C-8 PEO 400,000) | 50 | 66.1 | 82.25 |
| C-9 PEO 600,000) | 50 | 79.4 | 83.66 |
| C-10 PEO 900,000) | 50 | 57.8 | 88.11 |
| C-11 NPE | 50 | 233.3 | 52.01 |
| C-12 DCG #1 | 50 | 60.5 | 87.55 |
| C-13 NGG | 50 | 137.6 | 71.69 |
| 2 DCG #1/PEO 600,000 | 50 | 43.1 | 91.13 |

It has been found that the pitch control compositions of this invention are effective for controlling pitch/stickies deposition under conditions normally encountered on the papermachine as well. A pitch mixture was prepared from actual mill hardwood pitch containing sterols, fatty esters and fatty and resin acids. A pulp slurry containing 0.5% consistency bleached hardwood fiber, 500 ppm pitch and 300 ppm calcium was prepared in a beaker and pH adjusted to 4.5. Temperature was set at 35° C. with moderate agitation. A polyester film coupon (preweighed) was suspended in the beaker onto which the pitch was deposited. The agitation period was 10 minutes. After the 10 minute period, the coupon was lightly rinsed to remove fibers, air dried and weighed. The amount of deposition was determined by the difference of the initial weight of the coupon from the final weight. The results are reported in Table III.

TABLE III

CONTROL OF PITCH DEPOSITION ON PAPERMAKING EQUIPMENT

| SAMPLE | ACTIVE DOSAGE (PPM) | DEPOSITION (mg) | % INHIBITION |
|---|---|---|---|
| Blank | 0 | 24.1 | — |
| C-8 NPE | 20 | 15.3 | 36.51 |
| C-9 NPE | 50 | 10.9 | 54.77 |
| 3 DCG #1/PEO 600,000 | 10 | 4.6 | 80.91 |

The results indicate that the blend of Example 3, which is within the scope of this invention, significantly reduces the amount of pitch deposition at the lower pH's as well. This suggests that the blend is effective for the more acidic processes including post-bleaching operations and/or papermachine applications.

A seven day trial of the DCG #1/PEO 600,000 pitch control composition was conducted to compare this product with a leading commercial product. The trial was conducted at a Northeastern kraft pulp and paper mill. The DCG/PEO blend was applied to the hardwood side of the mill which produces several tons/day of fine paper. Baseline data at the mill showed daily pitch deposition amounts (recorded every second day and averaged) as well as product dosage for their current program which used a leading commercial product.

The amount of pitch deposition was determined by the weight of pitch accumulation on a strategically located stainless steel "pitch" plate. The product feed was split 70% to primary screen and 30% to the decker repulper. System pH was approximately 11.5 at the primary screen and pH=7 at the repulper (from acidification) and the temperature at the feed locations was about 66° C. to 72° C.

Three days prior to the start of the trial, pitch deposition at the mill was unusually high at 2.13 grams/day, even with the use of the competitive product. The mill was acidifying the decker pulper to reduce pH to 7.0 and began 3 days prior to the Drew trial. Average competitive pitch dispersant usage was 1.39#/ton. The competitive product is a solution of 9% polyvinyl alcohol in water. The average "active" dosage was 0.12 pounds per ton.

For the seven days of the trial, the average pitch deposition was 0.42 g/day (an 80.28% reduction in deposition) when DCG #1/PEO 600,000 pitch control composition was used at an average dosage of approximately 0.94 pounds per ton. On the other hand, the average pitch deposition was 2.13 g/day when the competitive product was used at 1.39 #/ton. This represents a 32% reduction in dosage of the DCG1/PEO 600,000 blend versus the competitive product. Moreover, since DCG #1/PEO 600,000 pitch control composition contains 4.7% actives, the average 'active' dosage for DCG #1/PEO 600,000 pitch control composition was 0.04 pounds per ton, nearly one third of the competitive product. The results of this trial are summarized in Table IV.

It is also significant that DCG#1/PEO 600,000 pitch control composition did not increase the foaming tendency of the black liquor in the pulpmill system. In fact, defoamer usage was trending downward over the course of the evaluation. Additionally, chemical interaction with other system process aids was minimized so deposition and production problems were not encountered downstream on the papermachine.

TABLE IV

COMMERCIAL TRIAL COMPARING COMPETITIVE PRODUCT

| | Pitch (p)/day | Prod. (#)/ton | Active Product (#)/ton |
|---|---|---|---|
| Competitive Product | 2.13 | 1.39 | 0.12 |
| EXAMPLE 3 RESULT | 0.42 (−80.28%) | 0.94 (−32%) | 0.04 (−66.6%) |

We claim:

1. A process for controlling the depositon of pitch in a hardwood or softwood pulp or papermaking process which comprises applying an effective pitch retarding amount of a liquid composition for the control of pitch deposition in pulp and paper making comprising in aqueous solution:

(a) a derivatized cationic guar, and (b) polyethylene oxide to a feedpoint in the pulp or papermaking process.

2. The process of claim 1 wherein the derivatized cationic guar is hydroxypropyl trimonium chloride.

3. The process of claim 2 wherein the charge density of the derivatized cationic guar is from 0.01 meq/g to 3.0 meq/g.

4. The process of claim 3 wherein the polyethylene oxide polymer has an average molecular weight of from 400,000 to 1,000,000.

5. The process of claim 4 wherein the pitch is pulp mill pitch and the feedpoint is the brown stock washer, screen room, or decker processing areas.

6. The process of claim 4 wherein the feedpoint is the post bleaching operation or the paper machine.

7. The process of claim 4 wherein the pitch control composition is applied directly to equipment used in pulp and papermaking.

8. The process of claim 4 wherein the pitch control composition is applied to the equipment of the pulp and papermaking process and through the shower process water.

* * * * *